United States Patent [19]

Archer

[11] 4,013,314

[45] Mar. 22, 1977

[54] LIFTING HOOKS

[76] Inventor: Jean-Francois Archer, 10 Avenue Georges-Clemenceau, 78670 Villennes, France

[22] Filed: Mar. 27, 1975

[21] Appl. No.: 562,856

[30] Foreign Application Priority Data

Mar. 29, 1974 France ..... 74.11174
Mar. 17, 1975 France ..... 75.08824

[52] U.S. Cl. ..... 294/82 R; 24/241 P
[51] Int. Cl.[2] ..... B66C 1/36
[58] Field of Search ..... 294/78 R, 82 R, 83 R; D8/252; 24/230.5 R, 230.5 CR, 230.5 S, 230.5 CS, 230.5 SA, 232–235, 241 R, 241 P, 241 PP, 241 PL, 241 PS, 241 SB, 241 CH, 241 SP; 59/93

[56] References Cited

UNITED STATES PATENTS

| | | | |
|---|---|---|---|
| 131,224 | 9/1872 | Paul | 294/82 R X |
| 559,640 | 5/1896 | Walker | 24/235 |
| 595,181 | 12/1897 | Langan | 294/78 R |
| 932,776 | 8/1909 | Gentner | 294/82 R |
| 1,324,676 | 12/1919 | Knudsen | 24/241 PS |
| 1,582,345 | 4/1926 | O'Bannon | 24/241 SB |
| 1,667,927 | 5/1928 | Clarke | 24/241 P |
| 1,682,617 | 8/1928 | Jensen et al. | 24/241 PP |
| 1,879,167 | 9/1932 | Freysinger | 24/241 P |
| 2,803,486 | 8/1957 | Larson et al. | 294/78 R |
| 3,317,972 | 5/1967 | Harley | 24/241 P |
| 3,879,807 | 4/1975 | Casale | 24/230.5 TP X |

FOREIGN PATENTS OR APPLICATIONS

| | | | |
|---|---|---|---|
| 610,965 | 10/1948 | United Kingdom | 294/82 R |

*Primary Examiner*—Johnny D. Cherry
*Attorney, Agent, or Firm*—Karl F. Ross; Herbert Dubno

[57] ABSTRACT

A lifting hook with a generally J-shaped body carries a spring-loaded safety catch which is swingable between an operating position across the hook mouth and a retracted position alongside the longer leg of the "J." In its operating position the catch is arrested by an abutment coming to rest against this longer leg, leaving a gap between the extended catch and the free end of the shorter leg of the J. The shorter leg progressively increases in width, from the bight of the J to its tip, and substantially parallels a pair of lateral ribs on the longer leg which lie close to the catch in its retracted position. In one embodiment, an eye-forming rim at the top of the hook has two lateral projections overhanging the pivot of the catch, the width of the hook body at the free end of its shorter leg substantially equaling its width at the projections and at the ribs. In another embodiment, the retracted catch comes to rest in a longitudinal depression formed on the longer leg by a boss above its pivot and a shoulder below its pivot, that boss being spaced from the widened tip by a distance equal to or only slightly greater than the clearance existing between this tip and the retracted catch.

9 Claims, 5 Drawing Figures

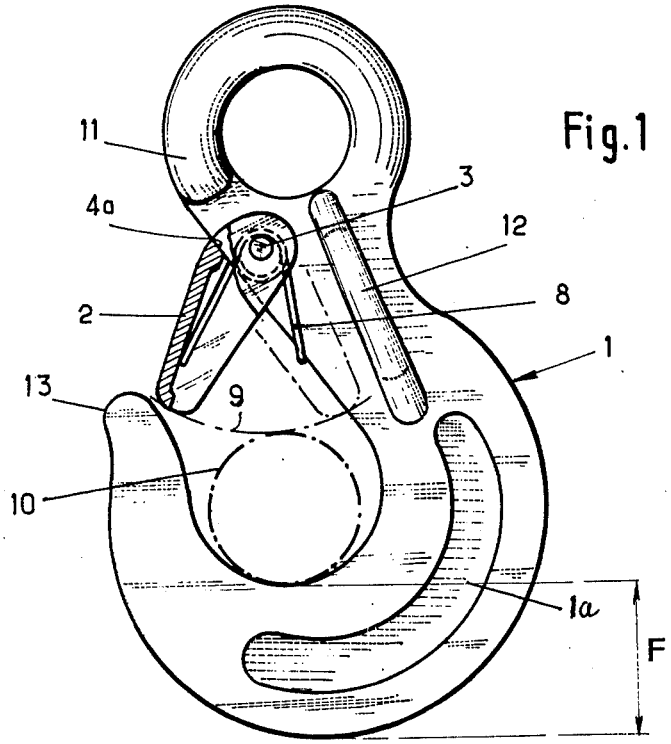
Fig.1
Fig.2
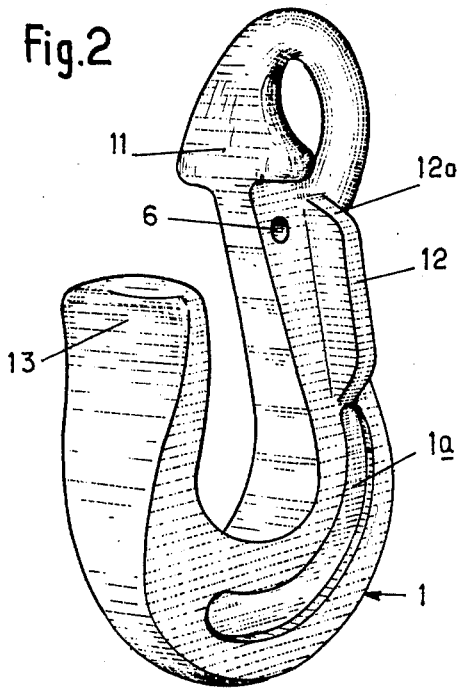
Fig. 3
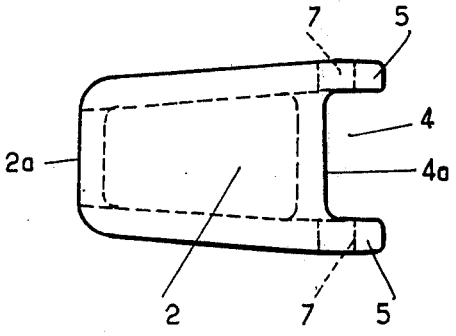

LIFTING HOOKS

FIELD OF THE INVENTION

This invention relates to lifting hooks.

BACKGROUND OF THE INVENTION

Conventional lifting hooks have a generally J-shaped body whose shorter leg has a free end or tip which tapers substantially to a point. The disadvantage of such a tapering tip portion is that, in the event that the hook is pivoted substantially about the eye of the hook, the resistance to disengagement of a cable or rope decreases towards the tip with obvious risk of complete disengagement.

OBJECTS OF THE INVENTION

An object of the present invention is to decrease this risk.

Another object is to provide means in such a hook for protecting a spring-loaded safety catch from damage.

SUMMARY OF THE INVENTION

According to a feature of my invention, a safety catch pivoted to the longer leg of a generally J-shaped hook body, near an eye formed at the top of that leg, is provided with abutment means coming to rest against the longer leg in the vicinity of its fulcrum in an operative position of the catch, athwart the hook mouth defined by the J, the catch terminating short of the tip of the shorter leg of the J in that operative position so that a cable or other load-lifting member, introduced into the hook mouth and coming to rest on a load-supporting bight portion of the hook, will clear the retracted latch and will let it swing into its operative position under the action of its biasing spring even if that member has a relatively large diameter.

Advantageously, the catch swingable within the hook mouth is bracketed by several protective formations integral with the hook body, such as a progressively widening tip portion of the shorter leg and a pair of lateral, longitudinally extending ribs on the longer leg which are generally parallel to the shorter leg; the catch, in its operative position, may also be overhung by a pair of lateral projections formed by the rim of the eye. The fulcrum of the catch lies between the tip of the shorter leg and the ribs of the longer leg.

According to another advantageous feature of my invention, the catch is fully retractable into a longitudinal depression of the longer leg formed by a boss above its fulcrum and a shoulder below its fulcrum.

BRIEF DESCRIPTION OF THE DRAWING

Two embodiments of my present invention will now be described, by way of example, with reference to the accompanying drawing, in which:

FIG. 1 is an elevation of a hook representing a first embodiment of my invention;

FIG. 2 is a perspective view of the body of the hook, with omission of a catch seen in FIG. 1;

FIG. 3 is a plan view of the catch of the hook shown in FIGS. 1 and 2;

SPECIFIC DESCRIPTION

Figure 5:
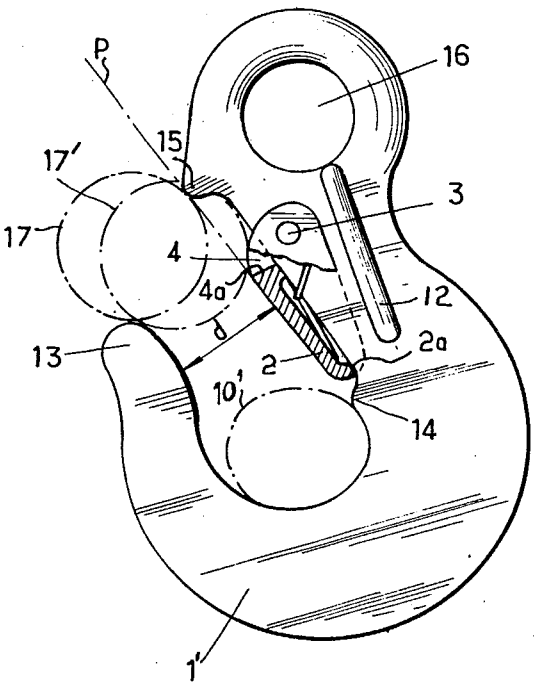
FIG. 5 is a view similar to FIG. 4, but with the catch shown in its retracted position.

In FIGS. 1 to 3 the body of a lifting hook 1 is shown on which a safety catch 2 is swingable about a pivot pin 3, adjacent the eye of the hook.

The catch 2 has a substantially U-shaped cross-section, with a concave side facing the longer leg of the generally J-shaped hook body, so that in a retracted position it straddles that leg as indicated in phantom lines in FIG. 1. A transverse recess 4, formed in the hook-engaging part of the catch, is defined by two ears 5 and is traversed by the pivot pin 3 which is threaded into an aperture 6 of the body 1 and into respective openings 7 of the ears 5. A hairpin spring 8 is seated on the pin 3 and bears with respective limbs upon the body 1 and upon an inner face of the catch 2. The spring thus biases the catch into its operative or retaining position athwart in which an edge 4*a* of the recess 4 of the catch abuts the hook body in the vicinity of its eye. It will be seen that, in the operative position referred to, the free end of the catch 2 does not abut the tip portion 13 of the hook but lies at a precertain distance from this tip portion. When the catch 2 is moved to its retracted position, the edge 2*a* swings along a segment of an imaginary cylinder 9 (dot-dash line) of relatively short radius, which enables a cable 10 or other load-lifting member of large diameter to engage the hook. If this cable should tend to become disengaged from the hook, the torque which it exerts on the catch is reduced in comparison with conventional lifting hooks since the lever arm of the catch is small.

Above the pin-receiving aperture 6, the eye of the hook has a rim with two opposite lateral appendices or projections 11 which lie above the ears 5 of the catch and blend progressively into the eye rim. The appendices 11 protect the catch and enable it to have a relatively large transverse dimension or width. As a result, the pin 3 can be long and can have a diameter sufficiently large to resist breakage.

Further, the body 1 of the hook comprises, adjacent to the catch 2, two lateral ribs 12 with sloping flanks 12*a* adapted to act as ramps or cams. The tip portion 13 of the hook, instead of being pointed as in conventional hooks, is of substantial width in a direction perpendicular to the plane of the hook, i.e., parallel to the axis of the eye, this tip widening progressively from the bight of the J formed by the hook body towards the free end of the shorter leg thereof in a continuous and symmetrical manner with respect to the median plane of the hook (thus to a plane bisecting the catch 2 as viewed in FIG. 1). The maximum dimension (width) of the tip portion 13 exceeds the general thickness of the body of the hook and is at least equal to the height F of the load-bearing section at the bight of the J. Furthermore, the width of the hook at the appendices 11, that is to say its dimension in a direction perpendicular to the plane of the hook, and at the ribs 12 is substantially equal to the maximum width of the tip portion 13.

Thus, the catch 2 is overhung at its front, back and top by the tip portion 13, the appendices 11 and the ribs 12 which thereby enable the hook to be deflected under load in relation to the cable 10 without risk of damage to the catch. The fulcrum 3 of the catch 2 will be seen to lie between the tip 13 and the ribs 12.

Surface grooves 1a are provided in the intermediate portion of the hook body and substantially reduce the weight of the hook without weakening it.

Figure 4:
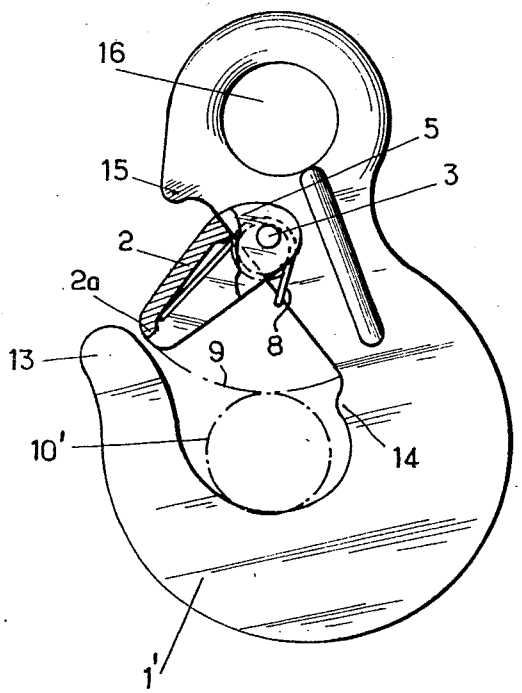
FIG. 4 is an elevation of a second embodiment, the catch being shown partially in section, in its operative position.

In the embodiment of FIGS. 4 and 5, the tip portion 13 of a modified hook 1' is again enlarged, from the bight of the J towards its free end, the maximum width of this tip exceeding the thickness of the hook body and being at least equal to the height or depth F of the load-bearing section as in the preceding embodiment. The safety catch 2 is of the same shape as that in FIGS. 1 to 3 and operates in the same way.

Here, too, the catch in its returning position does not abut the tip portion of the hook but is spaced therefrom by a certain gap. When the catch is retracted to its inoperative position, its edge 2*a* swings again over an arc of an imaginary cylinder 9 of relatively small radius, which enables engagement in the hook of a cable 10' of large diameter. If this cable tends to disengage the hook and bears upon the catch, the torque which it exerts on the catch remains small because of the short length of the lever arm of the catch.

On its internal wall, the body 1' comprises a projection or shoulder 14 which, when the catch 2 is in its retracted position, lies adjacent the edge 2*a* of the catch, substantially in the plane P of the catch or slightly beyond this plane. This projection 14 thus prevents the cable 10', whose diameter exceeds the distance *d* separating the tip portion 13 of the hook from the catch in its retracted position and which has been introduced into the mouth of the hook by being slightly flattened, from wedging itself against the wall of the hook body and the edge 2*a* of the catch. The cable 10' substantially maintains its oval cross-section and can thus be removed through the mouth of the hook in the same manner in which it was introduced.

Further, the body of the hook 1' comprises, on its internal wall, a second projection or boss 15 which lies at the eye 16 of the hook and outwardly of the catch 2. This projection is spaced from the tip of the hook by a distance which is generally of the same size as the clearance *d*, but which can be a little larger, as shown. If it were attempted to insert a rigid bar 17 of a diameter slightly larger than the distance *d* into the mouth of the hook, the projection 15 would prevent such introduction. In the absence of this projection, the bar 17 could reach the position 17' and strike the catch which might then be damaged, the boss 15 thus acting as a protective formation extending to the plane P in line with the exposed surface of the retracted catch. Shoulder 14 and boss 15 will therefore be seen to define between them a longitudinal depression into which the catch 2 is fully retractable when swung inwardly from its operative position. As in the preceding embodiment, catch 2 is also shielded by the lateral ribs 12 and the widened tip 13 between which it is bracketed.

I claim:

1. In a lifting hook comprising a generally J-shaped body with a longer leg and a shorter leg defining a mouth therebetween, an eye at the top of said longer leg, and a catch pivoted at a fulcrum near said eye to said longer leg for swinging within said mouth between a retracted position alongside said longer leg and an operative position athwart said mouth, said catch being provided with spring means biasing same into said operative position, said legs being interconnected by a bight portion for the support of a load-lifting member introduced into said mouth, the improvement wherein said catch is provided with abutment means coming to rest against said longer leg in the vicinity of said fulcrum in said operative position for preventing an outward swing of said catch beyond said operative position, said catch terminating short of the tip of said shorter leg in said operative position, said longer leg being provided with a pair of opposite lateral ribs extending in a longitudinal direction thereof and generally paralleling said shorter leg, said fulcrum lying between said ribs and said tip, said shorter leg progressively widening from said bight portion to said tip, its maximum width at said tip substantially equaling the width of said body at said ribs.

2. The improvement defined in claim 1 wherein said body has an annular portion surrounding said eye and broadening above said mouth into a pair of lateral projections which overhang said catch in said operative position thereof, said maximum width substantially equaling the width of said body at said projections.

3. The improvement defined in claim 1 wherein said catch has a generally U-shaped cross-section, with a concave side facing said longer leg, and straddles said longer leg in its retracted position.

4. The improvement defined in claim 3 wherein said longer leg has a longitudinal depression confronting said shorter leg, said catch being fully retractable into said depression.

5. The improvement defined in claim 1 wherein said catch is provided with a transverse recess bounded by a pair of lateral ears traversed by a pivot pin at said fulcrum, said abutment means being an edge of said recess.

6. In a lifting hook comprising a generally J-shaped body with a longer leg and a shorter leg defining a mouth therebetween, an eye at the top of said longer leg, and a catch pivoted at a fulcrum near said eye to said longer leg for swinging within said mouth between a retracted position alongside said longer leg and an operative position athwart said mouth, said catch being provided with spring means biasing same into said operative position, said legs being interconnected by a bight portion for the support of a load-lifting member introduced into said mouth, the improvement wherein said longer leg is provided above said fulcrum with a boss spacedly overlaying said catch and projecting toward the tip of said shorter leg, said catch in its retracted position being separated from said shorter leg by a clearance substantially equal to the distance of said tip from said boss.

7. In a lifting hook comprising a generally J-shaped body with a longer leg and a shorter leg defining a mouth therebetween, an eye at the top of said longer leg, and a catch pivoted at a fulcrum near said eye to said longer leg for swinging within said mouth between a retracted position alongside said longer leg and an operative position athwart said mouth, said catch being provided with spring means biasing same into said operative position, said legs being interconnected by a bight portion for the support of a load-lifting member introduced into said mouth, the improvement wherein said shorter leg progressively widens from said bight portion to its free end, said body having an annular portion surrounding said eye and broadening above said mouth into a pair of lateral projections overhanging said catch in said operative position thereof, the width of said body at said projections substantially equaling the maximum width of said shorter leg at said tip.

8. The improvement defined in claim 7 wherein said longer leg is provided with a pair of opposite lateral ribs extending generally parallel to said shorter leg in a longitudinal direction of said longer leg and lying close to said catch in the retracted position of the latter, said maximum width substantially equaling the width of said body at said ribs, said fulcrum lying between said tip and said ribs.

9. In a lifting hook comprising a generally J-shaped body with a longer leg and a shorter leg defining a mouth therebetween, an eye at the top of said longer leg, and a catch pivoted at a fulcrum near said eye to said longer leg for swinging within said mouth between a retracted position alongside said longer leg and an operative position athwart said mouth, said catch being provided with spring means biasing same into said operative position, said legs being interconnected by a bight portion for the support of a load-lifting member intoduced into said mouth, the improvement wherein said shorter leg progressively widens from said bight portion to its free end, said longer leg being provided with a pair of opposite lateral ribs extending generally parallel to said shorter leg in a longitudinal direction of said longer leg and lying close to said catch in the retracted position of the latter, the maximum width of said shorter leg at said tip substantially equaling the width of said body at said ribs, said fulcrum lying between said tip and said ribs.

* * * * *